US006012478A

United States Patent [19]

Park

[11] Patent Number: 6,012,478

[45] Date of Patent: Jan. 11, 2000

[54] GAS SUPPLY DEVICE FOR SEMICONDUCTOR MANUFACTURING APPARATUS

[75] Inventor: Jae Won Park, Chungcheongnam-Do, Rep. of Korea

[73] Assignee: LG Semicon Co., Ltd., Cheongju, Rep. of Korea

[21] Appl. No.: 08/950,976

[22] Filed: Oct. 15, 1997

[30] Foreign Application Priority Data

Oct. 17, 1996 [KR] Rep. of Korea ..... 96/46463

[51] Int. Cl.[7] ..... F17D 1/04

[52] U.S. Cl. ..... 137/240; 137/597; 137/613

[58] Field of Search ..... 137/240, 597, 137/613

[56] References Cited

U.S. PATENT DOCUMENTS 4,869,301 9/1989 Ohmi et al. ..... 137/240
4,917,136 4/1990 Ohmi et al. ..... 137/240
5,240,024 8/1993 Moore et al. ..... 137/38
5,605,179 2/1997 Strong, Jr. et al. ..... 137/240
5,749,389 5/1998 Ritrosi et al. ..... 137/240

*Primary Examiner*—Stephen M. Hepperle
*Assistant Examiner*—John Bastianelli
*Attorney, Agent, or Firm*—Fleshner & Kim

[57] ABSTRACT

A gas supply device for a semiconductor manufacturing apparatus supplies various kinds of fabrication gases to each apparatus in a fab line through non-overlapping supply pipes. The gas supply device includes a gas cabinet in which a plurality of gas containers are mounted each containing one of a plurality of fabrication gases. The gas supply device further includes a plurality of gas lines coupled to the gas cabinet, and a distributor that distributes the plurality of fabrication gases introduced through gas lines from the gas cabinet to supply the fabrication gases to each fabrication apparatus in a fab line through the non-overlapping supply pipes.

2 Claims, 5 Drawing Sheets

GAS SUPPLY DEVICE FOR SEMICONDUCTOR MANUFACTURING APPARATUS

BACKGROUND OF THE INVENTION

1. Field of the Invention

The present invention relates to a semiconductor manufacturing apparatus, and more particularly, to a gas supply device for a semiconductor manufacturing apparatus.

2. Background of the Related Art

Semiconductor device fabrication includes many processes including oxidation, diffusion, ion-implantation, metal deposition, and etching that require a gas supplier for supplying a variety of fabrication gases to the fabrication line (fab). FIG. 1 is a perspective view showing a related art gas supply device for a semiconductor manufacturing apparatus. As shown in FIG. 1, at a location outside a fab 7, a gas cabinet 1 is located for mounting a plurality of gas vessels 2 containing various kinds of fabrication gases such as SiH4, PH3, NF3, and CF4 that apparatuses 8 in the fab 7 require. At one side of the gas cabinet 1, one end of a guide duct 4 is mounted for guiding gas lines 3 respectively connected to the gas vessels 2.

On the other end of the guide duct 4, a number of distributors 5 corresponding to the gas lines 3 are mounted for supplying the fabrication gas introduced through the gas lines 3. A number of supply pipes 9 that corresponds to a number of the apparatuses 8 protrude from an upper portion of each distributor 5 to be correspondingly connected to the apparatuses 8 in the fab 7.

The operation of the related art gas supply device for a semiconductor manufacturing apparatus will now be described. First, when a fabrication gas is supplied from each of the plurality of gas vessels 2 mounted in the gas cabinet 1, each fabrication gas is sent to each distributor 5 through the gas lines 3 passing through the guide duct 4. Then, each fabrication gas sent to the corresponding distributor 5 is filtered through a plurality of gas filters (not illustrated), and flows through a separate supply pipe 9. Next, the fabrication gas flowing through each supply pipe 9 is supplied to one of the apparatuses 8 in the fab 7.

However, the related art gas supply device has various disadvantages. When a plurality of fabrication gases are supplied, the distributors 5 of a number equal to a number of the plurality of gas vessels 2 must be provided. Thus, when each supply pipe 9 protruding from each distributor 5 is connected to each of the apparatuses 8, the supply pipes are inefficiently used. In addition, the supply pipes 9 overlap and cause bends, and more complex routing schemes are required.

SUMMARY OF THE INVENTION

An object of the present invention is to obviate at least the above-described problems and disadvantages of the related art.

Another object of the present invention to provide a gas supply device for a semiconductor manufacturing apparatus that supplies various kinds of fabrication gases to each apparatus in a fab through non-overlapping supply pipes.

A further object of the present invention is to provide a gas supply device for a semiconductor manufacturing device that efficiently supplies a plurality of various kinds of fabrication gases to each apparatus using a single distributor.

To achieve at least the above objects in whole or in part, there is provided a gas supply device for a semiconductor manufacturing apparatus according to the present invention that includes a plurality of gas containers each containing one of a plurality of fabrication gases, a plurality of gas lines each coupled to one of the plurality of gas containers at a first end and a distributor coupled to second ends of the plurality of gas lines that distributes the plurality of fabrication gases to each of a plurality of fabrication apparatus in a fab line through a plurality of non-overlapping supply pipes.

To further achieve the above objects, there is provided a distributor for use in a semiconductor manufacturing apparatus according to the present invention that includes a housing, a first plurality of supply pipes for a first gas provided along a first axis, and a second plurality of supply pipes for a second gas provided along a second axis, wherein the first axis and the second axis extend in a first direction.

To further achieve the above objects, there is provided a semiconductor manufacturing apparatus according to the present invention that includes a plurality of gas lines each coupled at a first end to a gas container containing a fabrication gas, a plurality of supply pipes, a plurality of fabrication apparatus, wherein each of the supply pipes is coupled at a second end to one of the plurality of fabrication apparatus, and a distributor coupled to first ends of the plurality of gas lines that distribute at least two fabrication gases through at least two corresponding supply pipes coupled to one of the plurality of fabrication apparatus.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
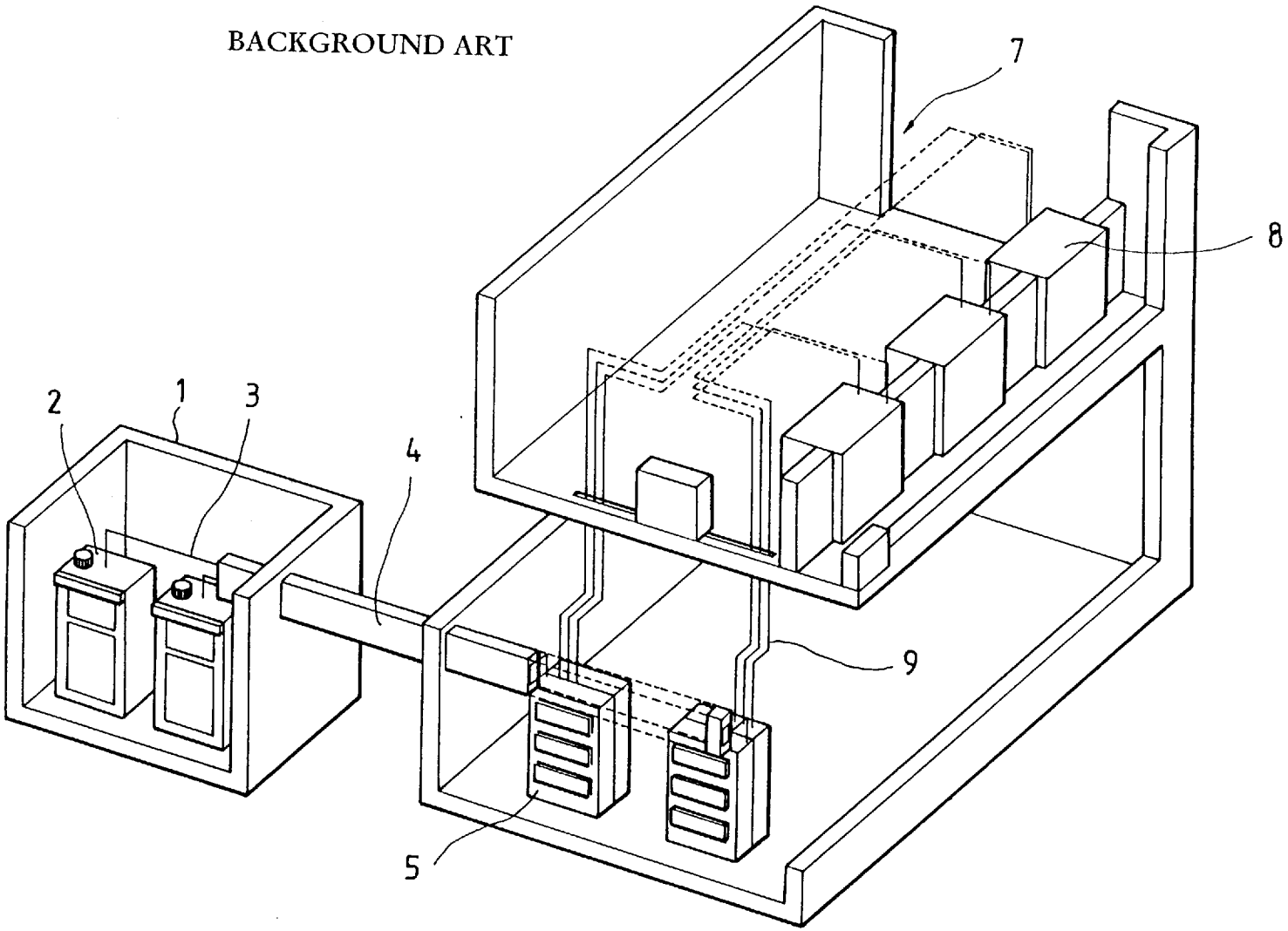
FIG. 1 BACKGROUND ART
FIG. 1 is a diagram showing a perspective view of a related art gas supply device for a semiconductor manufacturing apparatus.
Figure 2:
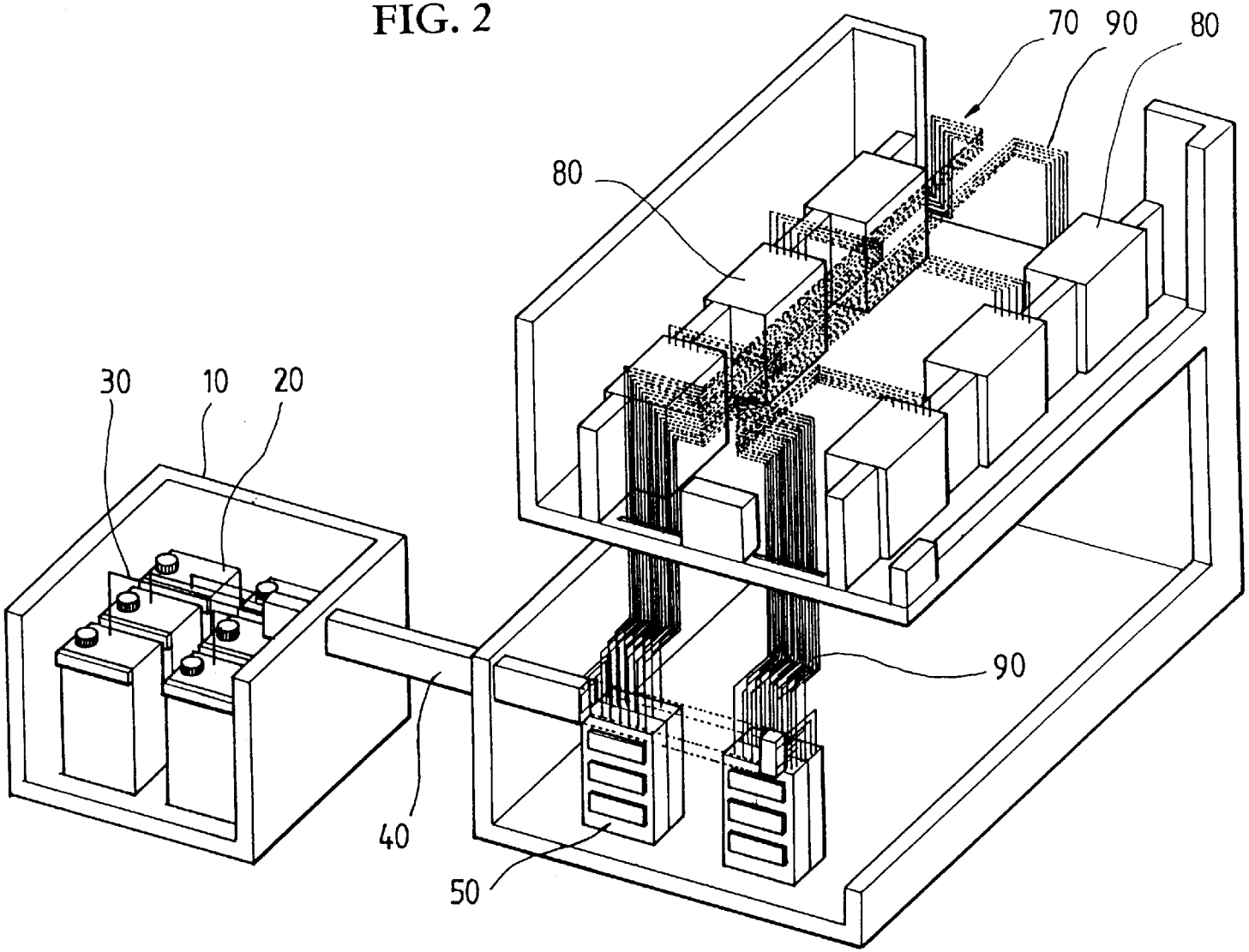
FIG. 2 is a diagram showing perspective view of a preferred embodiment of a gas supply device for a semiconductor manufacturing apparatus according to the present invention.

A first preferred embodiment of a gas supply device for a semiconductor manufacturing apparatus according to the present invention will now be described. As shown in FIG. 2, at a location outside a fab 70, a gas cabinet 10 is provided for mounting a plurality of gas containers 20 that contain fabrication gases such as SiH4, PH3, NF3, CF4 or the like. At one side of the gas cabinet 10, one end of a guide duct 40 is disposed for guiding a plurality of gas lines 30, each coupled to one of the gas containers 20. On the other end of the guide duct 40, are mounted a predetermined number of distributors 50 less than the number of gas containers 20 for supplying the fabrication gases from the gas containers 20 received through the gas lines 30. A number of supply pipes 90 preferably corresponds to a number of fabrication apparatuses 80 protrude from an upper portion of each of the distributors 50 to be correspondingly coupled to the apparatuses 80 in the fab 70.

Figure 3:
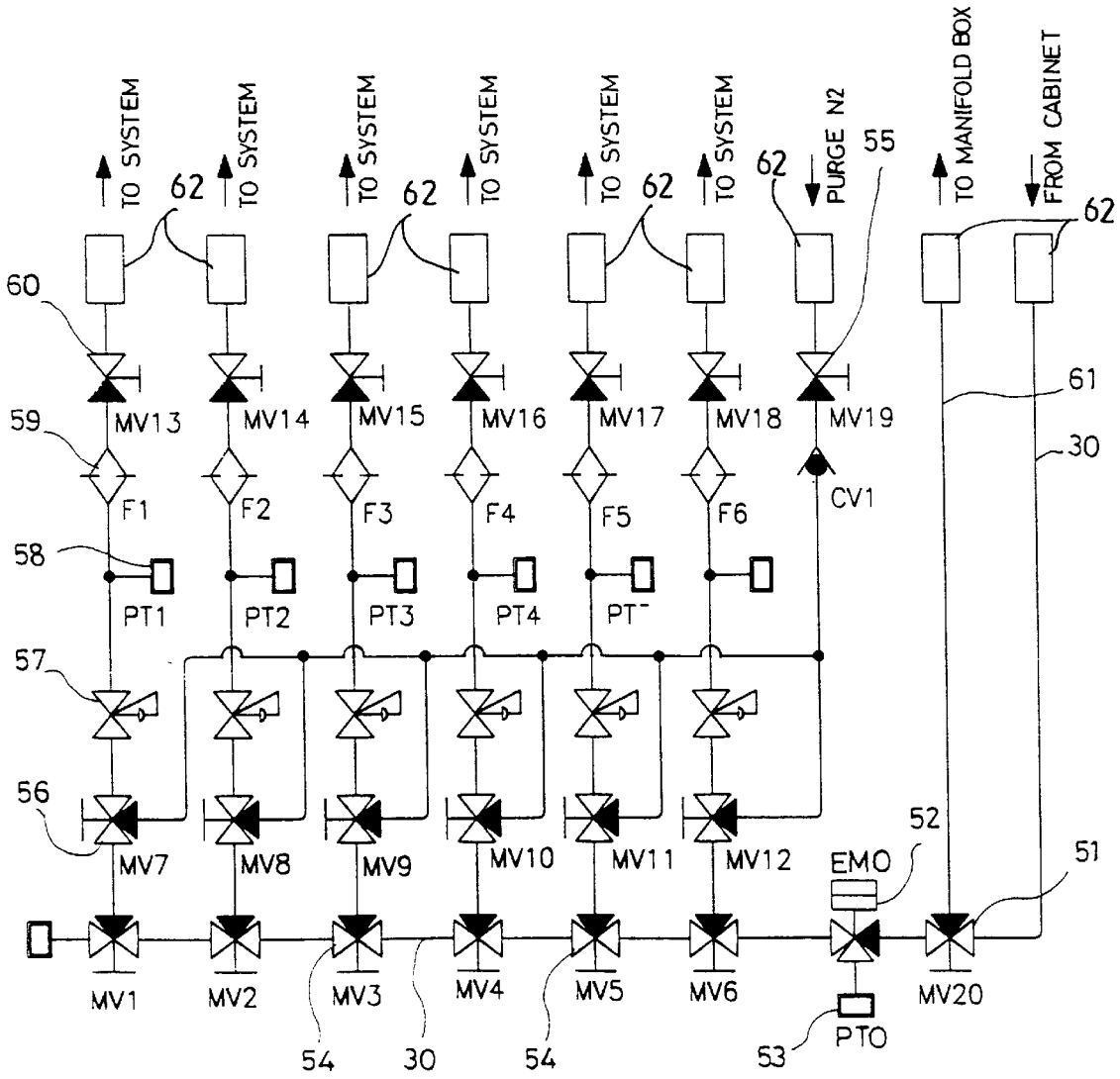
FIG. 3 is a schematic diagram showing a preferred embodiment of a distributor in a gas supply device for a semiconductor manufacturing apparatus according to the present invention.

FIG. 3 shows construction of a first preferred embodiment of a distributor for a gas supply device in a semiconductor manufacturing apparatus according to the present invention. At a predetermined portion of each of the gas lines 30, an extension valve 51 is disposed for distributing the fabrication gas supplied from the gas cabinet 10 in various directions. On one side of the extension valve 51, a stop valve 52 is mounted for cutting off the supply of the fabrication gas in case of an emergency such as a gas leakage. At the same location as the stop valve 52, a first sensor 53 is disposed for checking the pressure of the fabrication gas introduced through the extension valve 51.

In a corresponding gas line 30 on one side of the first sensor 53 and the stop valve 52, a plurality of supply valves 54 are provided at a predetermined interval for distributing the fabrication gas and supplying the gas to a set of apparatuses 80 of each of the plurality of apparatuses 80 in the fab 70. In the distributor 50, a purging gas control valve 55 is mounted for controlling the supply of a purging gas for removing impurities in the supply pipes 90. On one side of each of the supply valves 54, a plurality of purging valves 56 are disposed for receiving or cutting off the purging gas. On one side of the purging valves 56, a plurality of regulators 57 are mounted for regulating the amount of the fabrication gas.

After the regulators 57, a plurality of second sensors 58 are disposed for checking the final pressure of the fabrication gas. After the second sensors 58, a plurality of gas filters 59 are provided for filtering the fabrication gas. After the gas filters 59, a plurality of final supply valves 60 are disposed for regulating the output of the fabrication gas that has passed through the gas filters 59. From the extension valve 51, an extra supply pipe 61 is additionally coupled for supplying the fabrication gas to additional apparatuses 80 that are subsequently installed into the fab 70.

Figure 4:
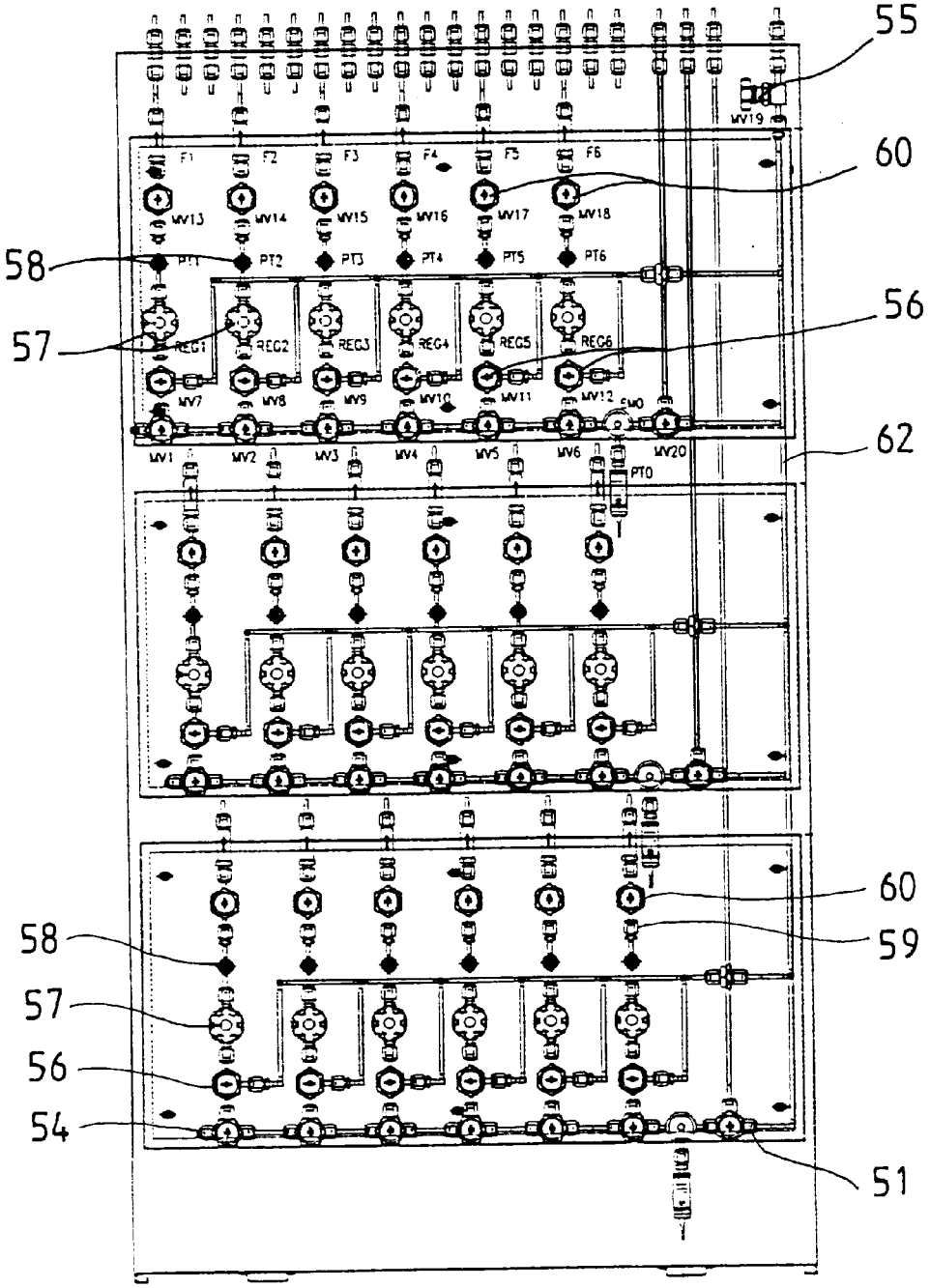
FIG. 4 is a schematic diagram showing another preferred embodiment of a distributor for three gases.
Figure 5:
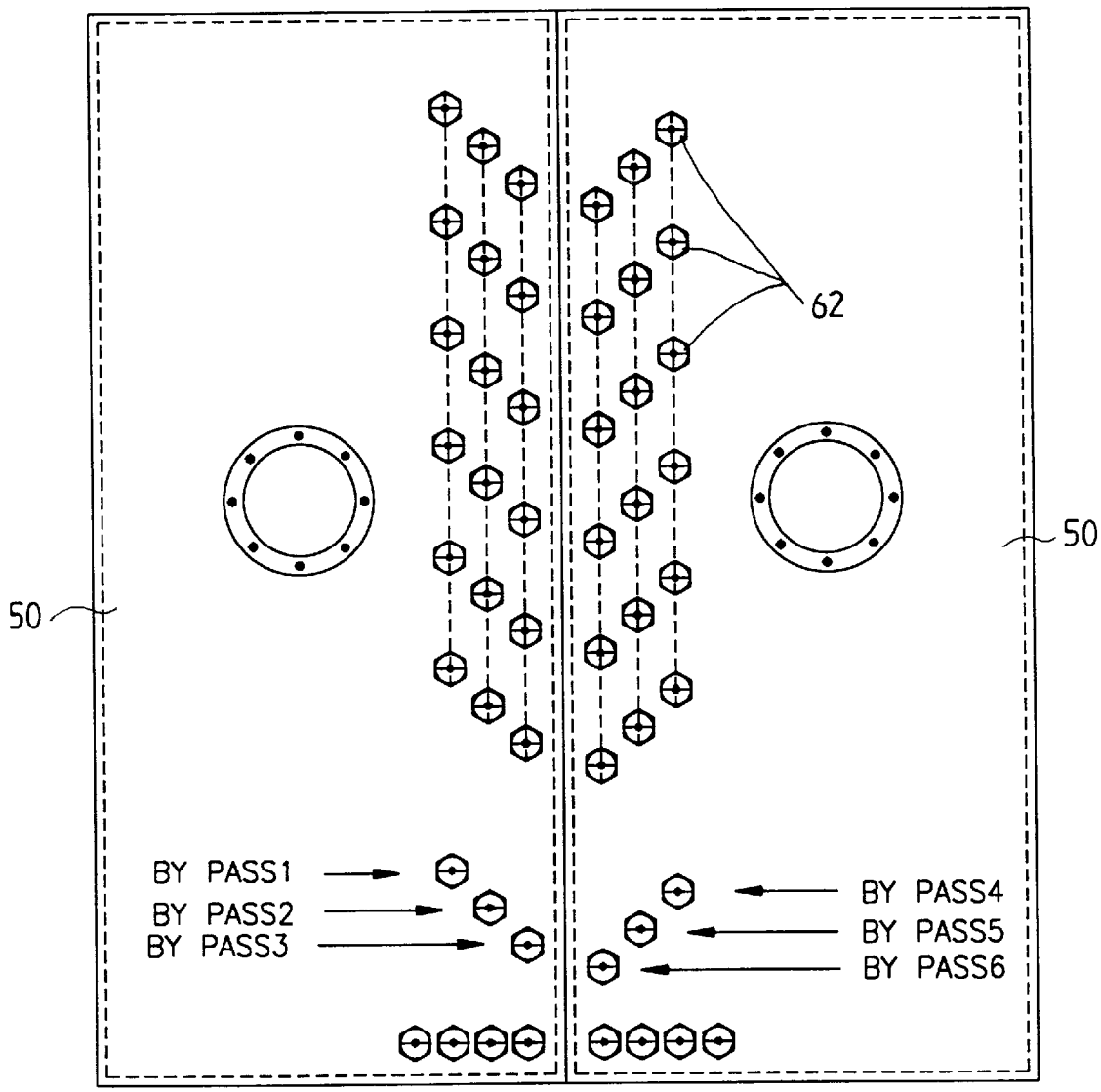
FIG. 5 is a diagram showing a plan view of two distributors of FIG. 4 stacked together.

FIG. 4 shows construction of a second preferred embodiment of a distributor for regulating three kinds of gases. In particular, a purging gas supply pipe 62 is disposed for distributing and supplying purging gas to each of the supply pipes 90, and the final supply valves 60 for regulating the output of each gas are coupled at intervals to each of the supply pipes 90 and staggered such that the final supply valves 60 do not cross each other. FIG. 5 is a plan view showing an instance where two distributors of FIG. 4 are stacked to supply fabrication gas to the apparatuses 80 installed in the fab 70.

Operations and effects of the preferred embodiments of the gas supply device and distributors for a semiconductor manufacturing apparatus will now be described. First, the purging gas control valve 55 is opened and a purging gas is introduced to at least one of the supply pipes 90 to remove any impurities. Next, when one of the fabrication gases supplied from the gas containers 20 is sent to one side of the extension valve 51 through the gas line 30, the first sensor 53 checks the pressure of the introduced fabrication gas.

Then, when the fabrication gas is distributed and sent through the supply valves 54 mounted in the gas line 30, one side of the purging valve 56 disposed on one side of the supply valve 54 is closed to cut off the intake of the purging gas, while the other side of the purging valve 56 is opened to send the fabrication gas through the gas line 30. Then, the regulators 57 disposed after the purging valves 56 regulate and pass the fabrication gas, and the second sensors 58 check the final pressure of the fabrication gas. The fabrication gas, which has passed through the second sensors 58 passes through the gas filters 59 to be filtered and flows on. When the final supply valves 60 are opened, the fabrication gas is sent to each of the apparatuses 80 in the fab 70 through the supply pipes 90 to perform a required operation for a fabrication.

Thus, the above-described preferred embodiments have various advantages. That is, a plurality of fabrication gases (e.g., three) are supplied from a single distributor 50 to each of the apparatuses of a fab through the supply pipes that do not overlap. When the demand for gas is increased, the extra supply pipe 61 mounted on one side of the extension valve 51 can be coupled to an additional supply pipe 90 to meet the demand.

Further, as shown in FIG. 5, when more fabrication gases are needed, two distributors 50 such as shown in FIG. 4 can be stacked together. Since the preferred embodiments distribute and supply various kinds of fabrication gas from one distributor, space in the fab 70 can be more effectively utilized. Further, since the fabrication gas is supplied to each apparatus in the fab, the productivity can be enhanced.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A semiconductor manufacturing apparatus, comprising:

a plurality of gas lines each coupled at a first end to a gas container containing a fabrication gas;

a plurality of supply pipes;

a plurality of fabrication apparatus, wherein the plurality of fabrication apparatuses comprise a fab line, and wherein each of the supply pipes is coupled at a second end to one of the plurality of fabrication apparatus; and a gas cabinet mounting a plurality of gas containers, wherein each of the gas containers contains one of a plurality of fabrication gases, and wherein each of the plurality of gas lines is coupled at the first end to one of the plurality of gas containers;

a distributor coupled to first ends of the plurality of gas lines that distribute at least two fabrication gases of the plurality of fabrication gases through at least two corresponding supply pipes coupled to one of the plurality of fabrication apparatus, wherein the distributor comprises, an extension valve disposed in each of the gas lines that distributes a corresponding fabrication gas, a stop valve disposed in said each of the gas lines subsequent to the extension valve that blocks the corresponding fabrication gas, a first sensor disposed with the stop valve that monitors a pressure of the corresponding fabrication gas, a plurality of supply valves provided in said each of the plurality of gas lines subsequent to the stop valve at a prescribed interval that distribute the corresponding fabrication gas to one of a plurality of supply pipes, a purging gas control valve that controls the supply of a purging gas, a plurality of purging valves each disposed subsequent to one of the plurality of supply valves that control flow of the purging gas, a plurality of regulators each disposed subsequent to one of the purging valves that regulate the corresponding fabrication gas passed through the purging valves, a plurality of second sensors each disposed subsequent to one of the plurality of regulators that check a final pressure of the corresponding fabrication gas, a plurality of gas filters each provided subsequent to one of the plurality of second sensors that filter the corresponding fabrication gas passed through the second sensors, and a plurality of final supply valves each disposed subsequent to one of the plurality of gas filters that control an output of the fabrication gas passed through the gas filters, wherein the semiconductor manufacturing apparatus further comprises a plurality of distributors.

2. The semiconductor manufacturing apparatus of claim 1, wherein the distributor supplies the fabrication gases to each of the plurality of fabrication apparatus.

* * * * *

UNITED STATES PATENT AND TRADEMARK OFFICE

CERTIFICATE OF CORRECTION

PATENT NO : 6,012,478

DATED : Jan. 11, 2000

INVENTOR(S) : Park

It is certified that error appears in the above-identified patent and that said Letters Patent is hereby corrected as shown below:

On the title page,
Item [30] Foreign Application Priority Data

Change "96/46463" to --96/46436--

Signed and Sealed this

Twelfth Day of December, 2000

*Attest:*

Q. TODD DICKINSON

*Attesting Officer*

*Director of Patents and Trademarks*